US007181148B2

(12) United States Patent
Sakai et al.

(10) Patent No.: US 7,181,148 B2
(45) Date of Patent: Feb. 20, 2007

(54) IMAGE FORMING APPARATUS AND DEVICE FOR DETERMINING THE DENSITY AND POSITION OF A TONER PATTERN

(75) Inventors: Tetsuya Sakai, Aichi-ken (JP); Katsuyuki Hirata, Aichi-ken (JP); Hironori Akashi, Okazaki (JP); Tatsuya Isono, Toyohashi (JP); Takashi Harashima, Toyokawa (JP); Masaki Tanaka, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 82 days.

(21) Appl. No.: 10/813,076

(22) Filed: Mar. 31, 2004

(65) Prior Publication Data

US 2004/0208663 A1 Oct. 21, 2004

(30) Foreign Application Priority Data

Apr. 18, 2003 (JP) ..... 2003-114045

(51) Int. Cl.
*G03G 15/00* (2006.01)

(52) U.S. Cl. ..... 399/49

(58) Field of Classification Search ..... 399/49, 399/74

See application file for complete search history.

(56) References Cited

U.S. PATENT DOCUMENTS

| | | | | |
|---|---|---|---|---|
| 4,796,065 | A | 1/1989 | Kanbayashi | |
| 6,633,734 | B2 * | 10/2003 | Maebashi et al. | 399/49 |
| 2003/0049039 | A1 * | 3/2003 | Suzuki | 399/49 |
| 2003/0214568 | A1 * | 11/2003 | Nishikawa et al. | 347/116 |

FOREIGN PATENT DOCUMENTS

| | | |
|---|---|---|
| JP | 2000-206761 | 7/2000 |
| JP | 2002-310901 | 10/2002 |

* cited by examiner

*Primary Examiner*—Quana Grainger
(74) *Attorney, Agent, or Firm*—Morrison & Foerster LLP

(57) ABSTRACT

A detection device used in an image forming apparatus, comprises a light-emitting element which emits light towards a toner pattern formed on an image carrier, a first light-receiving element which detects the light reflected from the toner pattern and a second light-receiving element which detects the light reflected from the toner pattern in a fashion different from the first light-receiving element. The detection device calculates the amount of toner of the toner pattern based on the output values from the first and second light-receiving elements as well as the position of the toner pattern based on the output value from the first light-receiving element.

13 Claims, 11 Drawing Sheets

(a)

(b)

IMAGE FORMING APPARATUS AND DEVICE FOR DETERMINING THE DENSITY AND POSITION OF A TONER PATTERN

This application is based on Japanese Patent Application No. 2003-114045 filed on Apr. 18, 2003, the content of which is hereby incorporated by reference.

BACKGROUND OF THE INVENTION

1. Field of the Invention

The present invention relates to an electrophotographic image forming apparatus such as a copier or printer, and more particularly to a device and method to detect the amount of toner on the image carrier of such apparatus, as well as the color shift amount.

2. Description of Related Art

In an electrophotographic image forming apparatus of the conventional art, such as a copier or printer, multiple photoreceptors are disposed side by side such that they face a belt that is driven to rotate, and toner images of different colors are formed on the photoreceptors and then sequentially transferred onto the belt in order to obtain a color image.

In such an apparatus, in order to form toner images on the photoreceptors, various devices including a charging device, developing device and exposure device are disposed around each photoreceptor. In order to optimize the output of each such device, multiple toner pattern images formed in accordance with different image formation parameter values are formed on each photoreceptor and transferred onto the belt. The amount of toner for each toner pattern image thus transferred is detected using a toner amount detection sensor (hereinafter an 'AIDC sensor') disposed such that it faces the belt, based on the result of which the output of each of the above devices is adjusted.

In addition, in the above apparatus, toner images of multiple colors are overlaid on top of one another in order to form a color image. Consequently, transfer of any of the various color toner images at an incorrect position results in color shift, making the final color image less than ideal. In order to prevent this from happening, according to the conventional art, detection patterns of each of the various colors (hereinafter 'resist patterns') are formed on the belt to detect the position of the toner image of each color prior to the actual image forming operation, and a shift in the position of a detection pattern for a given color, i.e., color shift, is detected using a resist sensor.

In recent years, focusing on the fact that the AIDC patterns and resist patterns described above are both formed on the same belt, a device that functions as both an AIDC sensor and a resist sensor has been considered, enabling resist patterns to be detected using an AIDC sensor.

However, the problem exists that AIDC sensors were originally developed to measure image darkness, and therefore cannot accurately detect a color shift amount.

OBJECT AND SUMMARY OF THE INVENTION

The present invention was created in order to resole the above problems, and a principal object thereof is to detect color shift among toner images of multiple colors with accuracy using an AIDC sensor or sensors.

Another object of the present invention is to accurately detect color shift among toner images of the various colors using a simple construction.

In order to attain these objects, the present invention comprises a detection device used in an image forming apparatus, such device including a light-emitting element that emits light towards a toner pattern formed on the image carrier, a first light-receiving element that detects the light reflected from the toner pattern, a second light-receiving element that detects the light reflected from the toner pattern in a fashion different from the first light-receiving element, and a control unit that calculates the amount of toner of the toner pattern based on the output values from the first and second light-receiving elements as well as the position of the toner pattern based on the output value from the first light-receiving element.

Based on the construction described above, according to the present invention, in an image forming apparatus, through the use of an AIDC sensor that includes two light-receiving elements and detects the toner amount on the image carrier, color shift among the toner images of the various colors can be accurately detected via the use of the output signal from one of the light-receiving elements.

Consequently, because no special detection device is required and the construction is simple, the manufacturing cost of the image forming apparatus does not increase.

When the toner amount on the image carrier is calculated, calculation is carried out using halftone patterns, dot patterns, screen patterns or solid patterns as the toner patterns, and when the color shift amount is calculated, calculation is performed using line patterns.

Furthermore, the light-emitting element includes a polarizing plate, and the first light-receiving element includes a polarizing plate having a direction of polarization parallel to the polarizing plate of the light-emitting element, while the second light-receiving element includes a polarizing plate having a direction of polarization different from the polarizing plate of the light-emitting element.

When the color shift amount is calculated based on the position of each toner pattern, the amount of reflected light is detected using the light-receiving element including a polarizing plate having a direction of polarization parallel to the polarizing plate of the light-emitting element.

The amount of light emission from the light-emitting element is adjusted based on the toner amounts calculated based on the amount of reflected light detected by the two light-receiving elements.

The present invention also comprises an image forming apparatus including an intermediate transfer unit, multiple image forming units disposed such that they face the intermediate transfer unit, multiple transfer elements that sequentially transfer the toner patterns formed by each of the image forming units onto the intermediate transfer unit, a light-emitting element that emits light towards a toner pattern formed on the intermediate transfer unit, multiple light-receiving elements that detect the reflected light from the toner pattern, and a control unit that calculates the toner amount of each toner pattern based on the output values from the multiple light-receiving elements as well as the position of each toner pattern based on the output value from one of the light-receiving elements.

The present invention also comprises a toner amount and color shift amount calculation method employed in an image forming apparatus for irradiating a toner pattern formed on the image carrier with detection light from an irradiation element via a polarizing plate, detecting the amount of light reflected therefrom using multiple light-receiving elements, and calculating the toner amount on the image carrier and the color shift amount based on the amount of reflected light detected by the light-receiving elements, wherein when the toner amount on the image carrier is calculated calculation is carried out based on the amount of reflected light detected by two or more light-receiving elements, and when the color shift amount is calculated, calculation is carried out based on the amount of reflected light detected by one light-receiving element.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Figure 1:
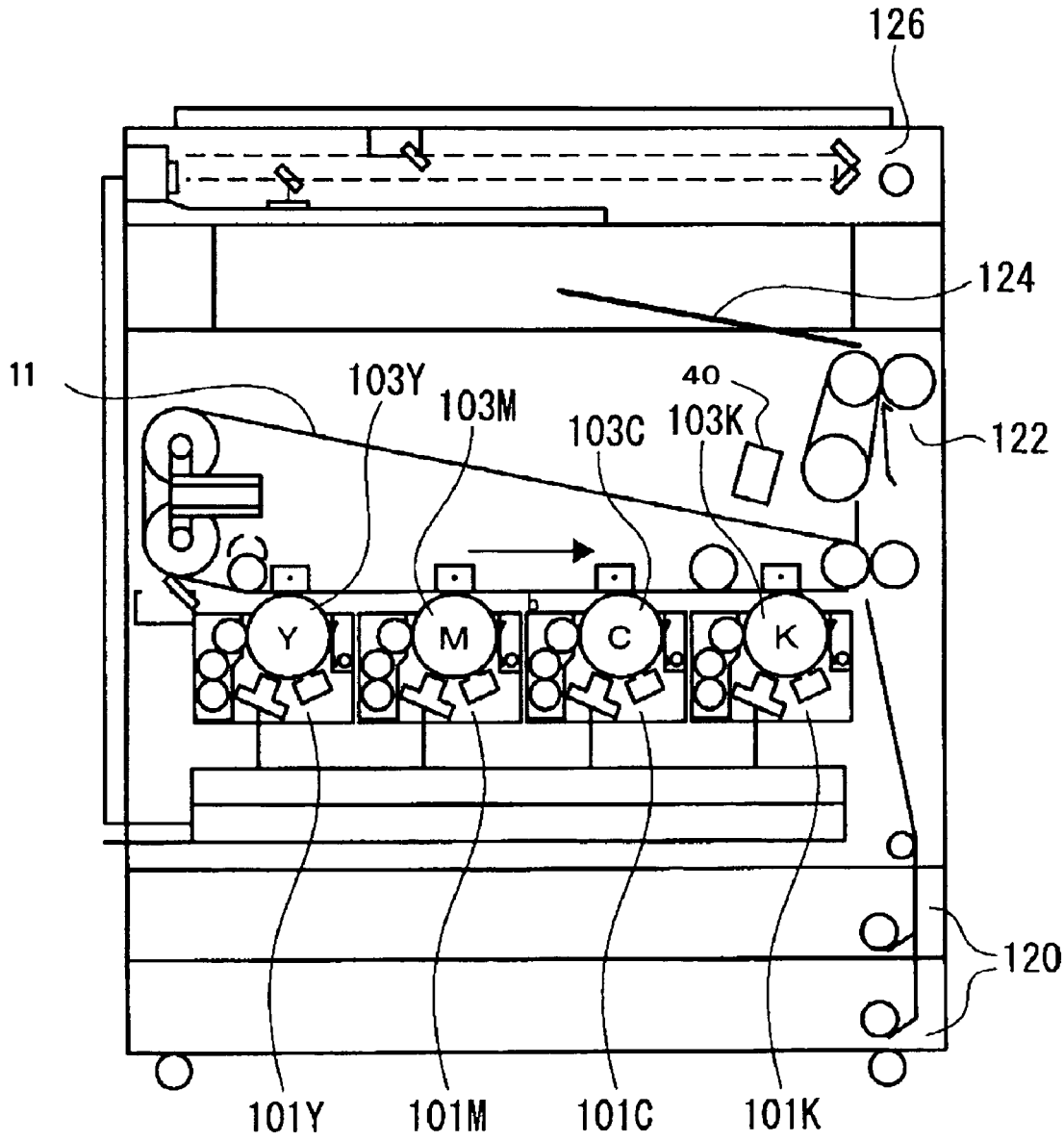
FIG. 1 is a front elevation to explain the construction of a tandem-style, full-color image forming apparatus comprising an embodiment of the present invnetion.
Figure 2:
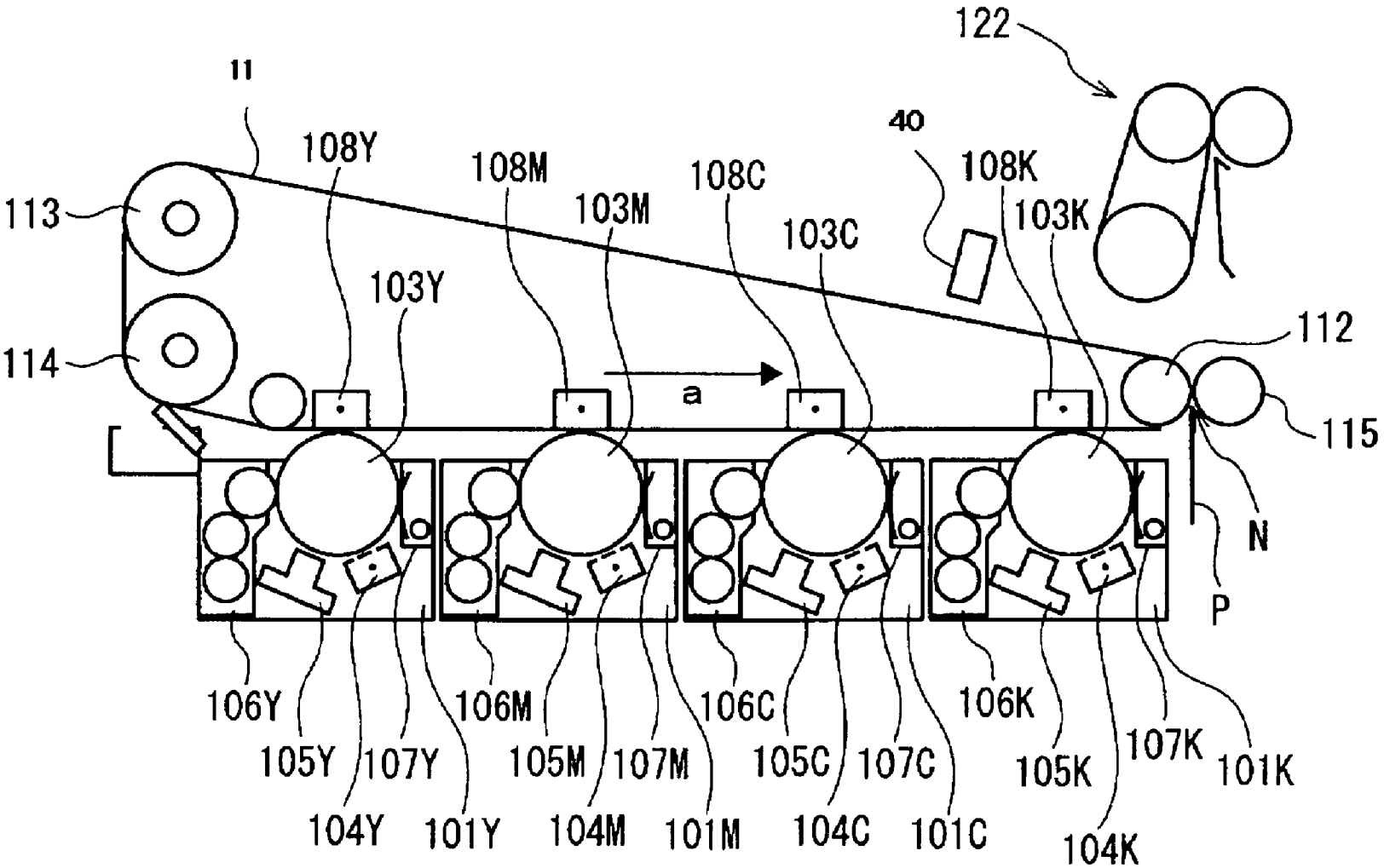
FIG. 2 is an enlarged front elevation of the area of the image forming apparatus shown in FIG. 1 in which the image forming units and intermediate transfer belt are disposed.

An embodiment of the present invention is described below. FIG. 1 is a front elevation to explain the construction of a tandem-style, full-color image forming apparatus, and FIG. 2 is an enlarged front elevation of the area thereof that includes the image forming units and the intermediate transfer belt.

This image forming apparatus has four image forming units 101Y, 101M, 101C and 101K, which respectively correspond to the four colors of yellow (Y), magenta (M), cyan (C) and black (K) and are serially disposed along an intermediate transfer belt 11, for the three primary colors red (R), blue (B) and green (G) that are obtained via chromatic decomposition of the original document image. Each image forming unit 101Y-101K respectively has a photoreceptor 103Y, 103M, 103C and 103K, as well as a charger 104Y, 104M, 104C and 104K, an exposure device 105Y, 105M, 105C and 105K, a developing device 106Y, 106M, 106C and 106K, and a cleaner 107Y, 107M, 107C and 107K, which are disposed around each photoreceptor.

The image forming units are detachably mounted in the image forming apparatus main body.

First transfer devices 108Y, 108M, 108C and 108K are disposed such that they respectively face the photoreceptors 103Y, 103M, 103C and 103K across the intermediate transfer belt 11.

The intermediate transfer belt 11 is suspended over a second transfer roller 112, a drive roller 113 and a wrapping roller 114, and moves in the direction of the arrow (a) at a constant speed based on the rotation of the drive roller 113 that is driven by a driving device not shown.

Furthermore, a pressure roller 115 is disposed such that it faces the second transfer roller 112 across the intermediate transfer belt 11, and recording paper P is conveyed from a paper supply device 120 towards the nipping area N that is formed between the intermediate transfer belt 11 and the pressure roller 115. A fusing device 122 is disposed on the downstream side of the nipping area N in terms of the direction of conveyance of recoding paper P, and a paper ejection unit 124 is disposed downstream from the fusing device 122.

On the downstream side of the pressure roller 115 in terms of the direction of rotation of the intermediate transfer belt 11 are disposed AIDC sensors 40, which are described in detail below, at positions close to the intermediate transfer belt 11.

To briefly explain the operation of the construction described above, the image signals output from the original document reader 126 or a personal computer or the like not shown are broken down into cyan, magenta, yellow and black signals, which are respectively output to the image forming units 101Y, 101M, 101C and 101K.

The exposure device 105Y first operates based on the image signals output to the image forming unit 101Y, and a latent image is formed on the photoreceptor 103Y. This latent image is developed by the developing device 106Y, whereupon a yellow toner image is formed. The yellow toner image on the photoreceptor 103Y is transferred onto the intermediate transfer belt 11 through the operation of the first transfer device 108Y.

In synchronization with the yellow toner image transferred onto the intermediate transfer belt 11 moving under the first transfer device 108M, a latent image is formed on the photoreceptor 103M of the image forming unit 101M, and a magenta toner image is developed by the developing device 106M. The magenta toner image on the photoreceptor 103M is transferred onto the intermediate transfer belt 11 such that it is overlaid onto the yellow toner image through the operation of the first transfer device 108M.

Similarly, the cyan toner image formed on the photoreceptor 103C of the image forming unit 101C is transferred onto the intermediate transfer belt 11 such that it is overlaid onto the overlapping yellow and magenta toner images, and the black toner image formed on the photoreceptor 103K of the image forming unit 101K is transferred onto the intermediate transfer belt 11 such that it is overlaid onto the yellow, magenta and cyan toner images. Consequently, a full-color toner image comprising images of the four colors, i.e., a yellow image, a magenta image, a cyan image and a black image overlaid on top of one other, is formed on the intermediate transfer belt 11.

In synchronization with the full-color toner image formed on the intermediate transfer belt 11 moving towards the second transfer roller 112, a sheet of recording paper P is conveyed from the paper supply device 120 towards the nipping area N that is formed between the intermediate transfer belt 11 and the pressure roller 115. The full-color toner image is transferred onto the sheet of recoding paper P through the operation of the second transfer roller 112, and is fused and bonded onto the recoding paper P by the fusing device 122, whereupon the recording paper P is ejected onto the paper ejection unit 124.

In order to appropriately control the amount of toner on the photoreceptor of each image forming unit 101Y, 101M, 101C or 101K to enable the formation of high-quality images, such image formation parameters as the charging voltage, development bias and exposure amount must be set to the optimal values.

Figure 10:
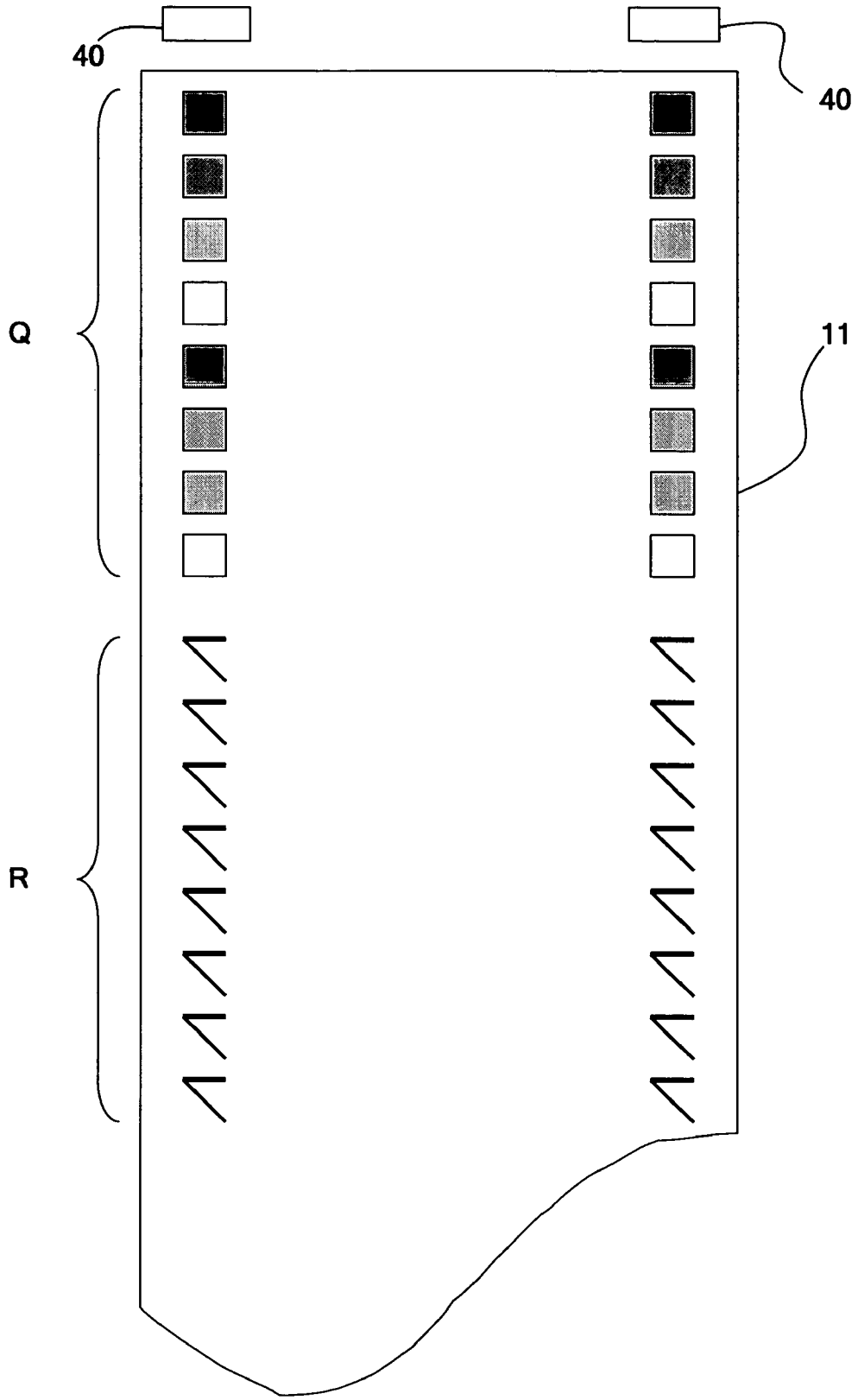
FIG. 10 is a drawing to explain the toner patterns formed on the intermediate transfer belt.

For this purpose, in this embodiment, as shown in FIG. 10, multiple rectangular toner patterns Q, which have different image formation parameter values, i.e., different charging voltages, development biases and exposure amounts, are formed on the intermediate transfer belt, the toner patterns Q are detected by the AIDC sensors disposed near the intermediate transfer belt such that the sensors detect the toner amount of each toner pattern, and the results of the detection are used to determine the image formation parameter values to use.

Figure 3:
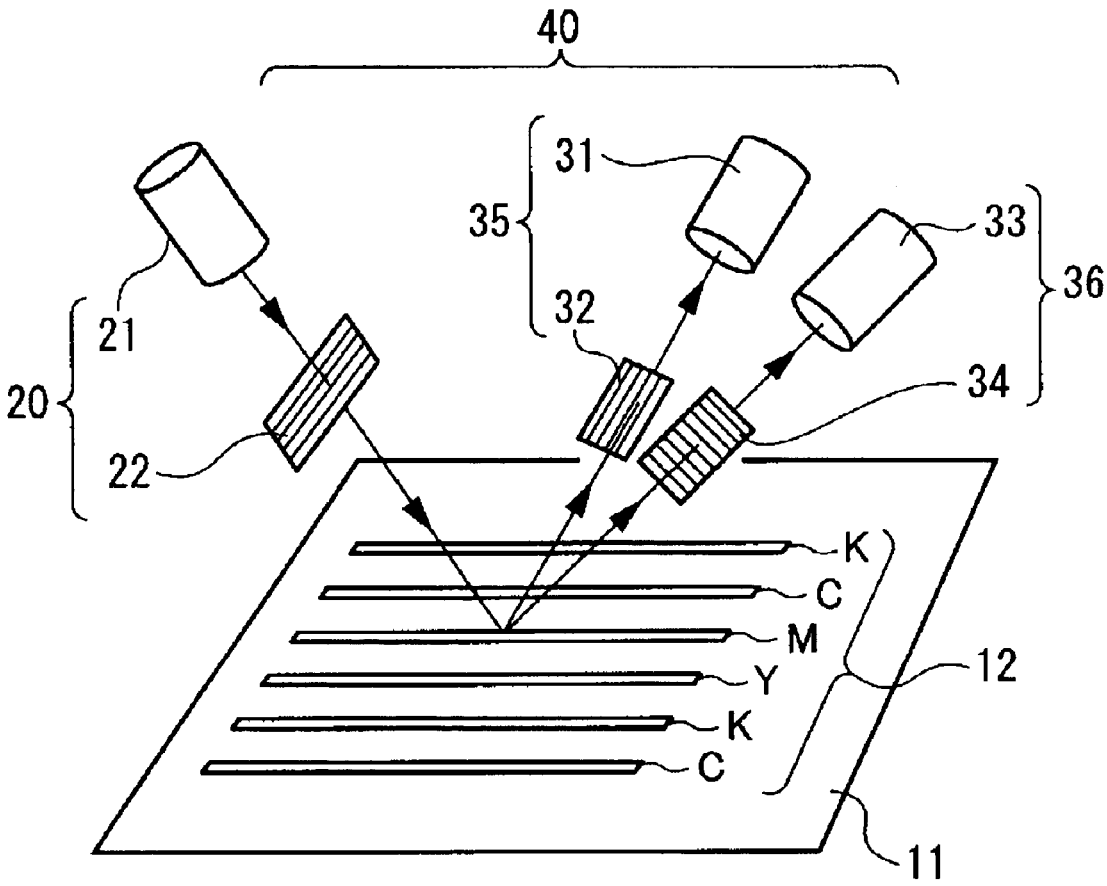
FIG. 3 is a drawing to explain the construction of the AIDC sensor used in the embodiment of the present invention.
Figure 4:
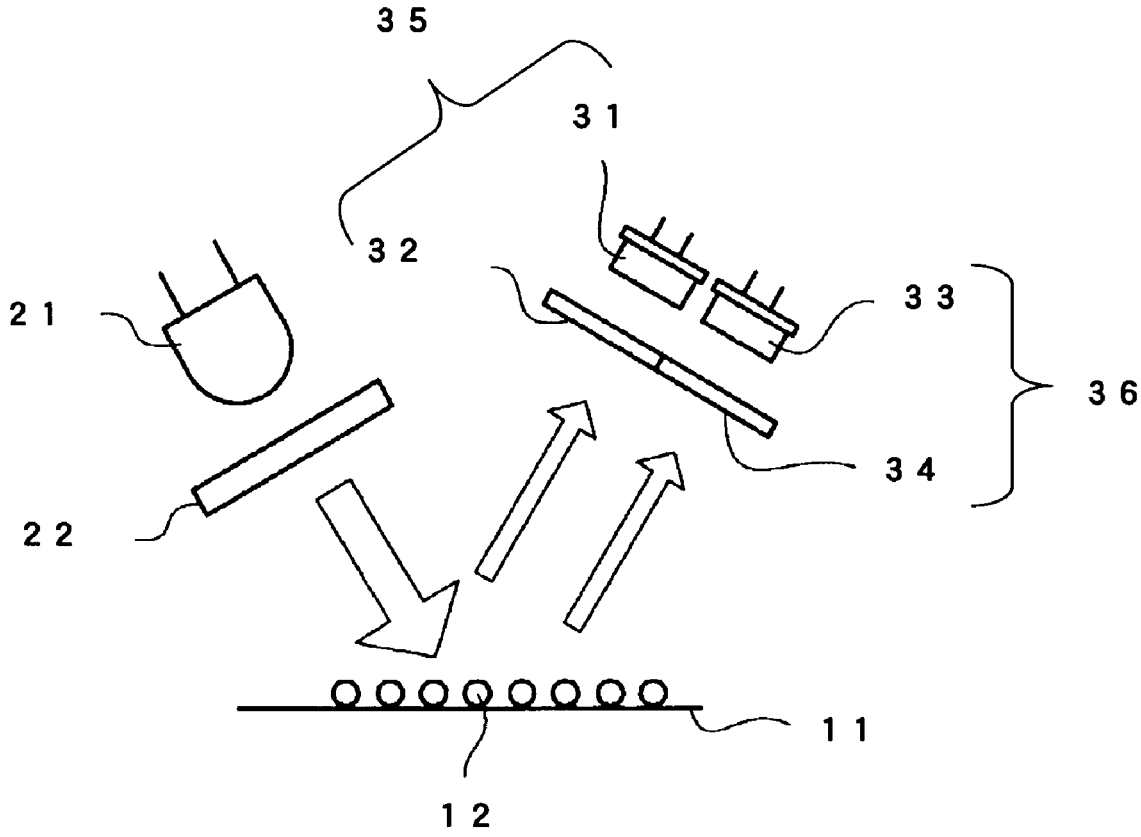
FIG. 4 is a drawing to explain the principle of detection of the toner amount using the AIDC sensor.

FIG. 3 is a drawing showing the construction of the AIDC sensor that detects the toner amount in this embodiment of the present invention. FIG. 4 is a drawing to explain the principle of the detection of the toner amount by the AIDC sensor.

Each AIDC sensor 40 is composed of an light-emitting element 20 that emits light through a polarizing plate 22 towards a toner pattern 12 formed on the image carrier, a first light-receiving element 35 that detects the amount of light reflected from the toner pattern via a polarizing plate 32 having a direction of polarization parallel to the polarizing plate 22 of the light-emitting element 20, and a second light-receiving element 36 that detects the amount of reflected light through a polarizing plate 34 having a different direction of polarization from the polarizing plate 22 of the light-emitting element 20.

To described more specifically, the light-emitting element 20 comprises a P-wave polarizing plate 22 and a light-emitting diode 21, while the first light-receiving element 35 is composed of a P-wave polarizing plate 32 and a photodiode 31 and the second light-receiving element 36 is composed of an S-wave polarizing plate 34 that has a direction of polarization that differs by 90° from the P-wave polarizing plate 32, as well as a photodiode 33. The first light-receiving element 35 and the second light-receiving element 36 are located close to each other. 12 represents the toner patterns formed on the intermediate transfer belt 11.

The light that that was emitted from the light-emitting diode 21 of the light-emitting element 20 and passed through the P-wave polarizing plate 22 is directed to a toner pattern 12 of yellow, magenta, cyan or black formed on the intermediate transfer belt 11, and the reflected light from the pattern is received by the photodiode 31 of the first light-receiving element 35, which is equipped with a P-wave polarizing plate 32, as well as by the photodiode 33 of the second light-receiving element 36, which is equipped with an S-wave polarizing plate 34.

Where the light emitted from the light-emitting diode 21 is directed to the intermediate transfer belt 11 via the polarizing plate 22, the reflected light includes the light reflected by the intermediate transfer belt 11 itself and the light reflected by the toner pattern 12.

The light reflected by the intermediate transfer belt 11 enters the P-wave photodiode 31 via the polarizing plate 32 because its direction of oscillation does not change due to the smooth surface of the intermediate transfer belt 11. The amount of such light is deemed Bn.

On the other hand, the direction of oscillation of the light reflected by a toner pattern 12 changes randomly because the toner particles have irregular shapes and together present a rough surface. Consequently, part of the light reflected by the toner pattern 12 enters the P-wave photodiode 31 via the polarizing plate 32, and part of it enters the S-wave photodiode 33 via the polarizing plate 34. Because the direction of oscillation of the light reflected by the toner pattern 12 is random, the amount of light TP that enters the P-wave photodiode 31 is equal to the amount of light TS that enters the S-wave photodiode 33 (TP=TS).

On the other hand, because the light reflected by the intermediate transfer belt 11 and the light reflected by the toner pattern 12 enter the P-wave photodiode 31, the detection value by the P-wave photodiode 31 becomes (Bn+TP). In addition, because the light reflected by the intermediate transfer belt 11 has a different direction of oscillation and therefore cannot pass through the polarizing plate 34, the detection value output by the S-wave photodiode 33 becomes TS (TS=TP).

Therefore, the amount of light reflected by the intermediate transfer belt 11 can be obtained by calculating the difference (Bn) between the detection value (Bn+TP) output by the P-wave photodiode 31 and the detection value TS (TS=TP) output by the S-wave photodiode 33.

Since a large amount of reflected light from the intermediate transfer belt 11 means that the amount of toner on the intermediate transfer belt 11 is small and a small amount of reflected light means that the amount of toner on the intermediate transfer belt 11 is large, the toner amount can be obtained from the amount of light reflected from the intermediate transfer belt 11.

Figure 5:
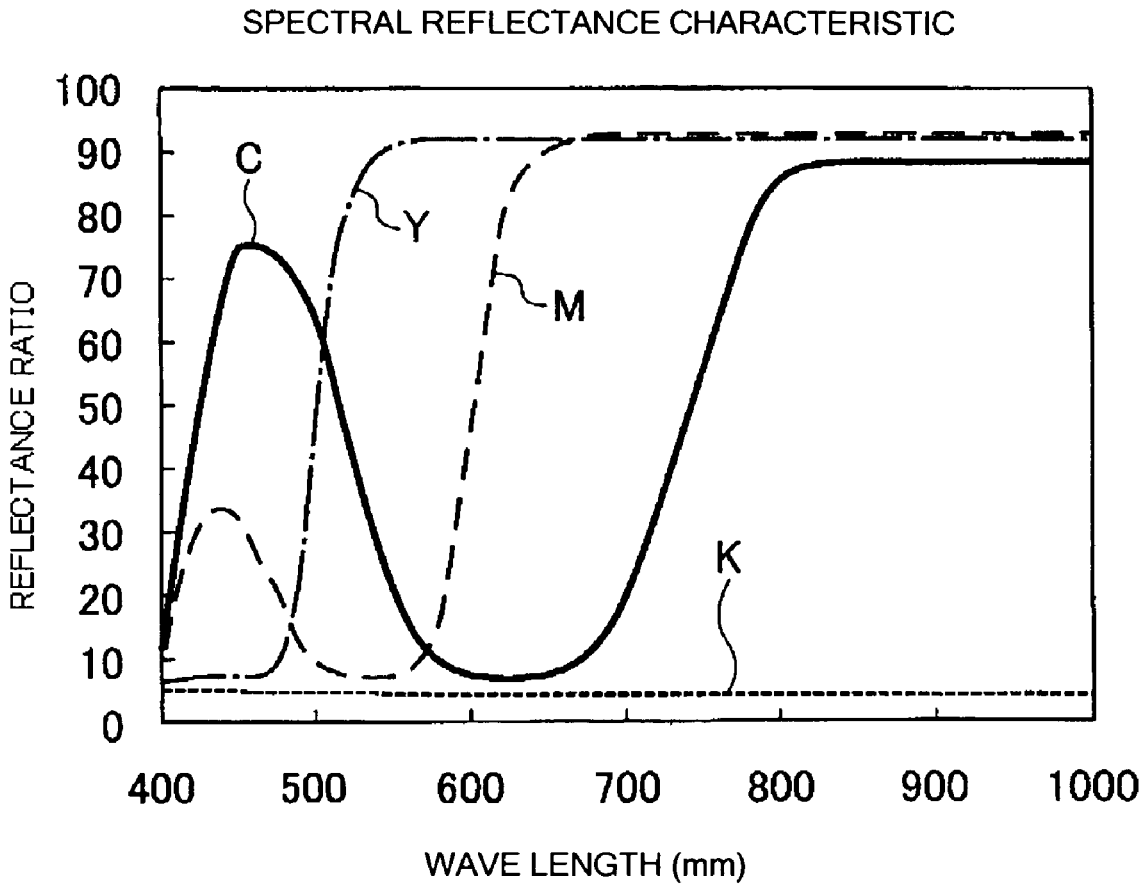
FIG. 5 is a drawing showing the spectral reflectance characteristic of the toner of each color.

FIG. 5 is a drawing showing the spectral reflectance characteristic of the toner of each color. Because the color toners, i.e., the yellow toner, magenta toner and cyan toner, reflect most of the light, the total amount of color toner can be detected by the AIDC sensor 40 with high accuracy. On the other hand, because black toner absorbs most light and reflects very little light, the amount of black toner can also be detected by the AIDC sensor 40 with high accuracy in the same manner as with color toner.

Figure 6:
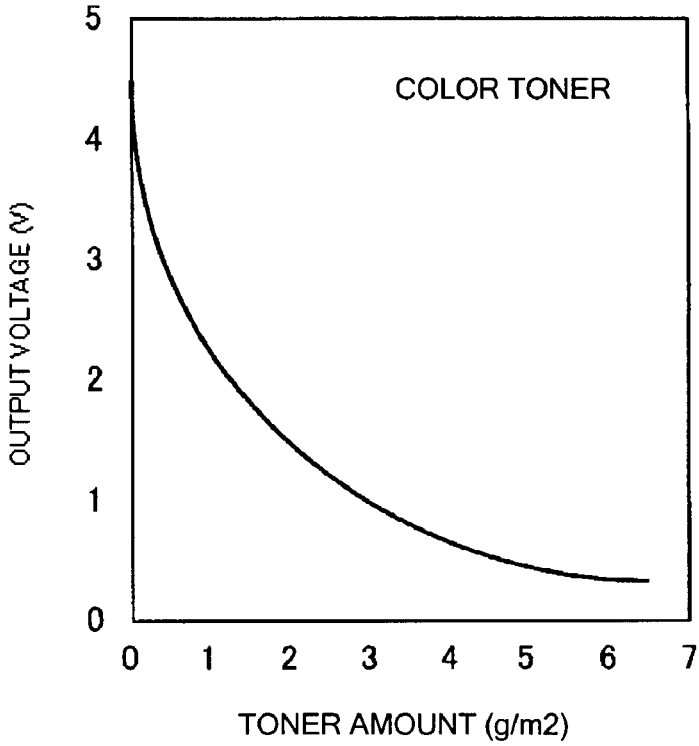
FIG. 6 comprises drawings to explain the relationship between the output voltage from the AIDC sensor and the color toner amount and the black toner amount, respectively, as detected by the AIDC sensor.
Figure 6:
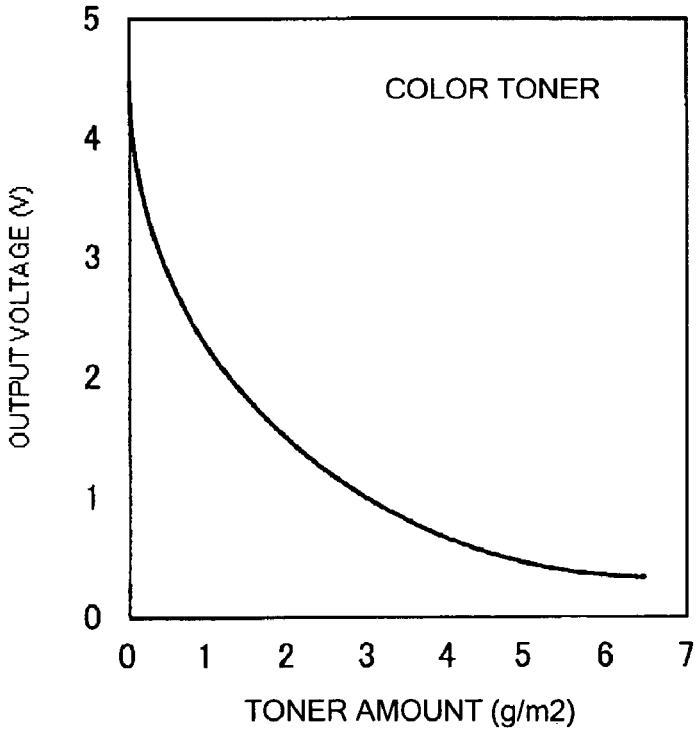

FIG. 6 comprises drawings showing the relationship between the color toner amount and the black toner amount ($g/m^2$) when the amount of toner is detected using the AIDC sensor 40 and the output voltage (V) from the AIDC sensor. FIG. 6(*a*) shows the relationship for color toner, and FIG. 6(*b*) shows the relationship for black toner.

By detecting the amount of toner on the photoreceptor using the AIDC sensor 40 and controlling the operation parameters such as the charging voltage, development bias and exposure amount to their optimal values based on the detection result, high-quality images can be formed.

Figure 7:
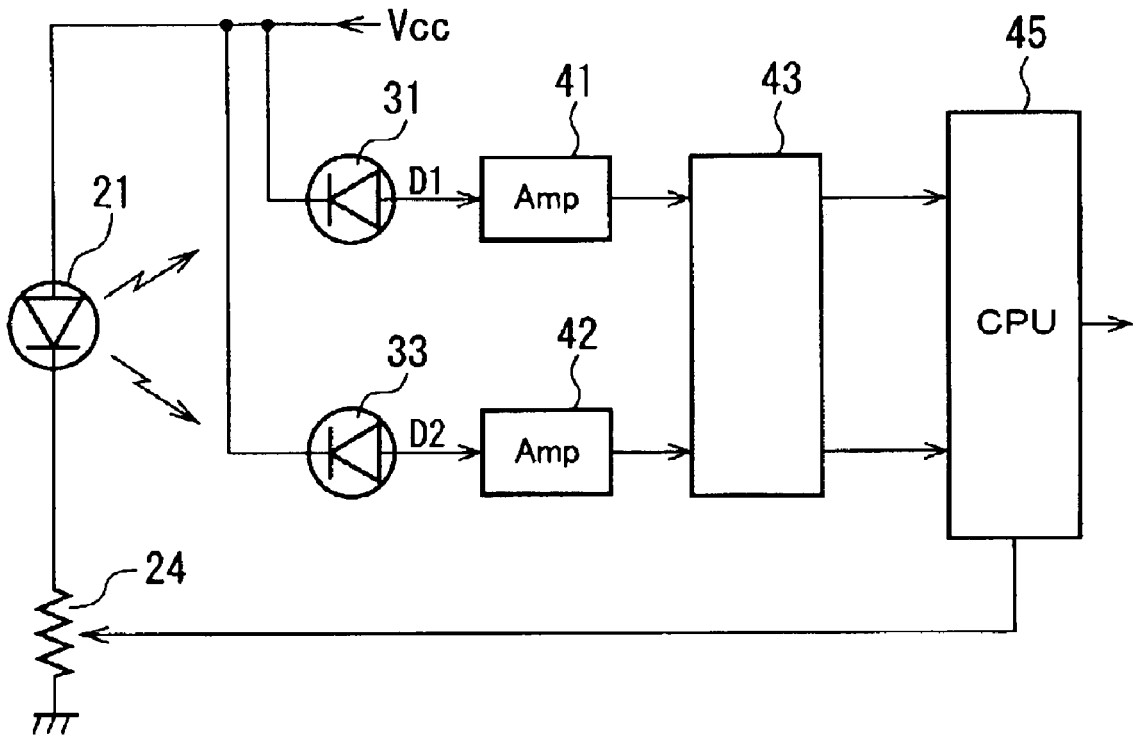
FIG. 7 is a circuit diagram of the image forming apparatus of the embodiment of the present invention.

FIG. 7 shows the control circuit of the image forming apparatus of this embodiment. It shows in particular the area related to the present invention, and other areas are omitted from the drawing. The light that was emitted from the light-emitting diode 21 of the light-emitting element 20 and passed through the P-wave polarizing plate 22 is reflected by the toner pattern 12 and enters the photodiode 31 of the first light-receiving element 35 via the P-wave polarizing plate 32, as well as enters the photodiode 33 of the second light-receiving element 36 via the S-wave polarizing plate 34. The signal D1 detected by the photodiode 31 is amplified by an amplifier 41 and is input to the processing circuit 43.

The signal D2 detected by the photodiode 33 is amplified by an amplifier 42 and is input to the processing circuit 43.

The processing circuit 43 calculates the signal (D1–D2) indicating the difference between the signal D1 and the signal D2 for each toner pattern 12 of each color, and this signal and the signal D1 are sent to the CPU 45. The CPU 45 seeks the amount of light reflected by the intermediate transfer belt 11 based on the signal (D1–D2), i.e., the toner amount on the intermediate transfer belt 11, and controls the operation parameters such as the charging voltage, development bias and exposure amount to the optimal values for each image forming unit based on the toner amounts of each color.

Color shift detection will now be explained.

A color image is formed by placing toner images of the four colors, i.e., yellow, magenta, cyan and black images, on top of each other. If the toner images are not placed on top of each other with exact accuracy, i.e., if color shift occurs, the resulting image becomes less than ideal. It is therefore necessary to detect and correct for any color shift. In the image forming apparatus of the embodiment of the present invention, as shown in FIG. 10, detection patterns R (hereinafter 'resist patterns') are formed for each color on the intermediate transfer belt 11, and any positional shift regarding the detection patterns of each color is detected using the AIDC sensor 40, which operates as a color shift amount detection sensor that detects color shift (hereinafter a 'resist sensor').

As described above, the toner amount can be calculated from the output voltage from the AIDC sensor 40, and because the output voltage is a waveform voltage represented by a wave having a certain width and height, the center of gravity position of the wave also represents the position of the detected resist pattern for each color. Therefore, by calculating the center of gravity position of the output voltage wave (in actuality, the wave cut out using a prescribed threshold), the amount of color shift among the multiple colors can be sought. If positional correction in the main scanning direction and the secondary scanning direction, skew correction, bow correction, intermediate transfer belt uneven speed correction, etc. are carried out for each image forming unit based on the detected color shift amount, color shift can be eliminated.

Figure 8:
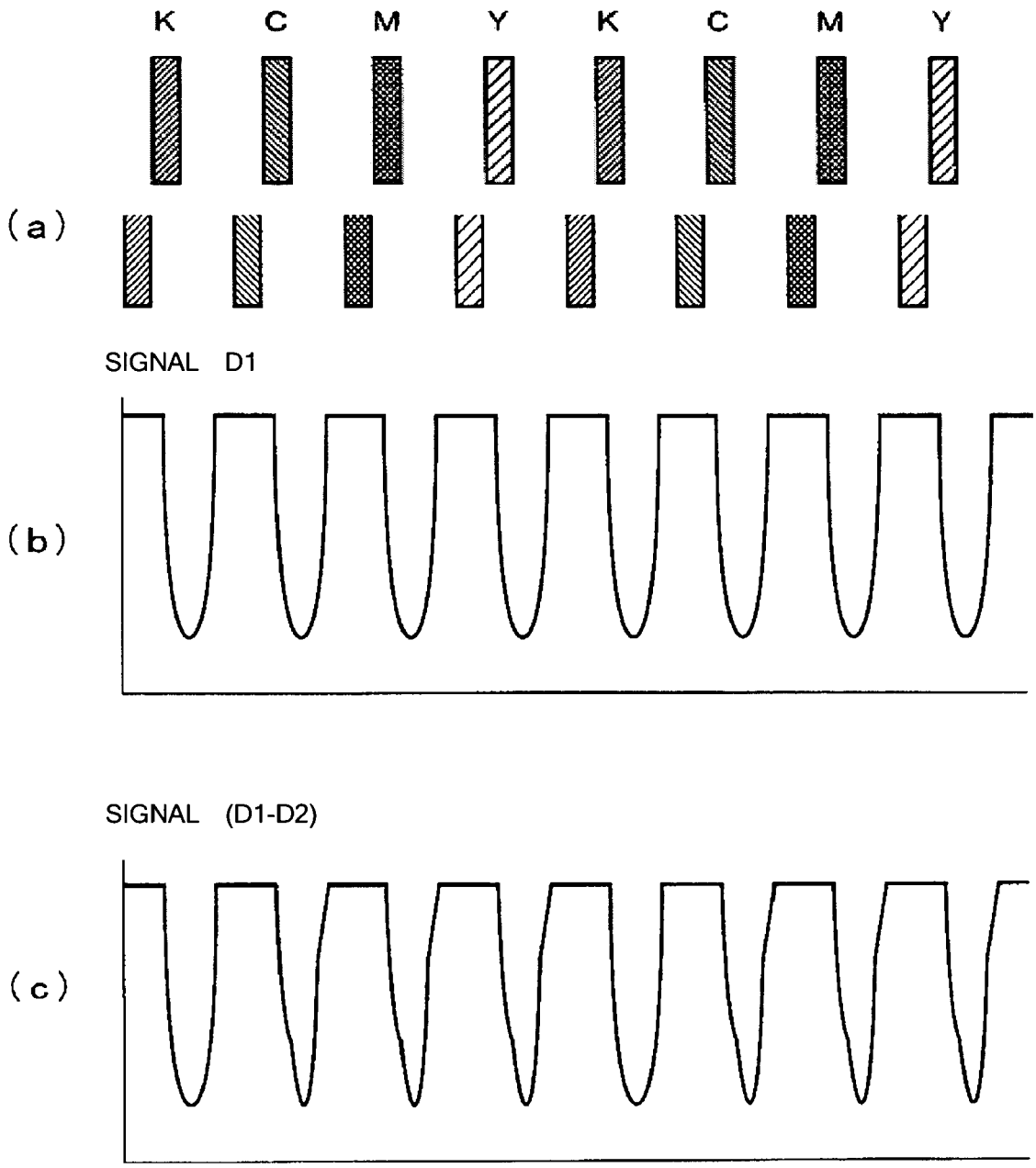
FIG. 8 comprises drawings showing the resist pattern for each color and the waveform of the signal D1 calculated by the processing circuit after being cut at the threshold level, as well as the waveform of the signal (D1–D2)

FIG. 8 comprises drawings showing the toner patterns 12 comprising resist patterns for each color and the waves of the signal D1 cut at the threshold level and calculated by the processing circuit 43, as well as of the signal (D1–D2). FIG. 8(*a*) shows the resist patterns for each color, FIG. 8(*b*) shows the signal D1 waves and FIG. 8(*c*) shows the signal (D1–D2) waves.

Figure 9:
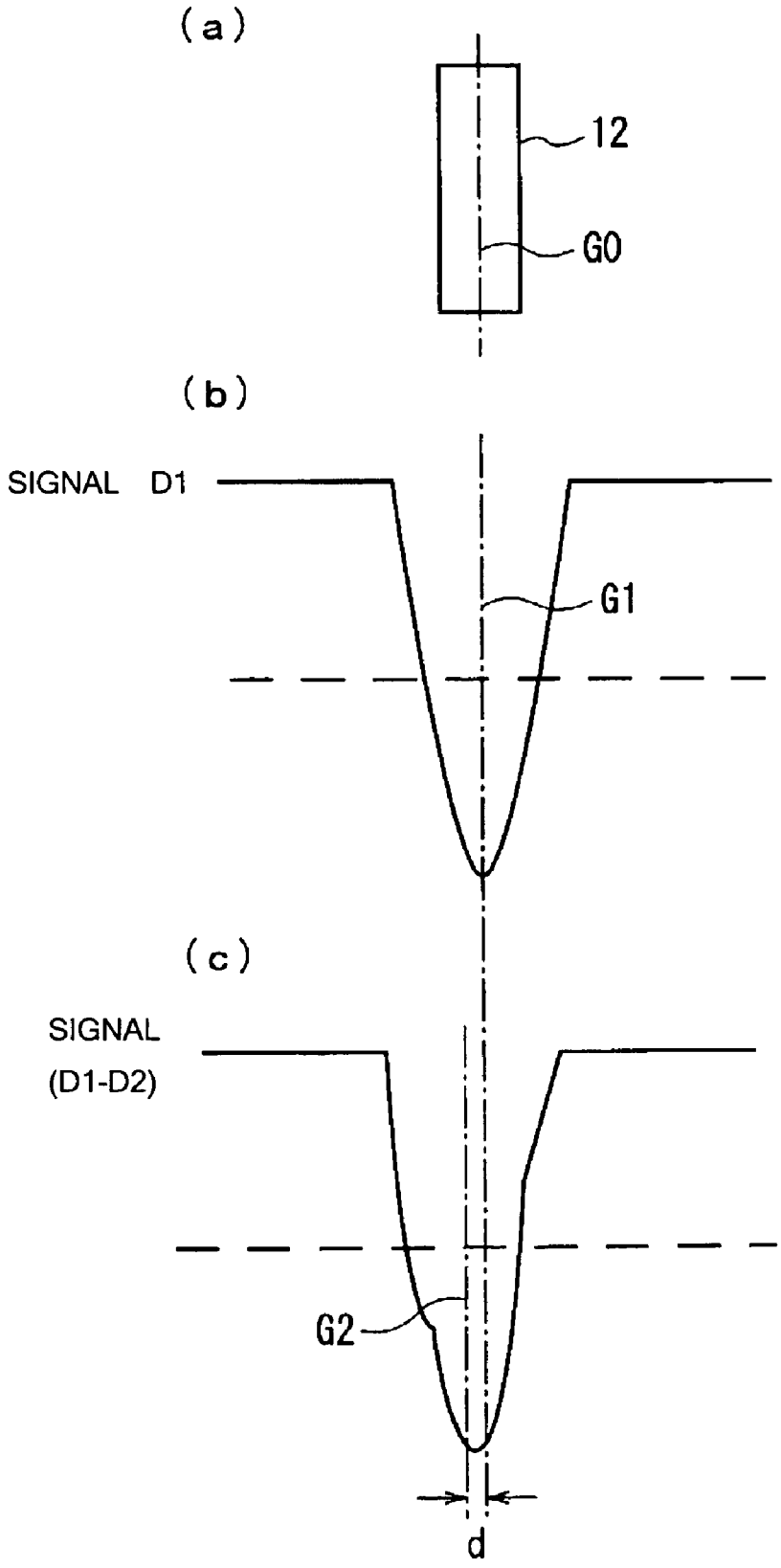
FIG. 9 comprises drawings to explain the resist pattern's center of gravity position G0, the signal D1 wave and center of gravity position G1 and the difference signal (D1–D2) wave and center of gravity position G2.

FIG. 9 comprises drawings to explain the center of gravity position G0 of a resist pattern, a signal D1 wave and its center of gravity position G1, and a different signal (D1–D2) wave and its center of gravity position G2. FIG. 9(*a*) shows the center of gravity position G0 of a resist pattern. FIG. 9(*b*) shows a signal D1 wave and its center of gravity position G1, and FIG. 9(*c*) shows a signal (D1–D2) wave and its center of gravity position G2.

The difference signal (D1–D2) wave is uneven because since the photodiode 31 of the first light-receiving element 35 and the photodiode 33 of the second light-receiving element 36 cannot be positioned at the exact same spot, there is some distance in between, and accordingly there is a difference between the times at which the reflected light enters the two photodiodes. Consequently, while the signal D1 wave center of gravity position G1 is perfectly aligned with the resist pattern center of gravity position G0, the signal (D1–D2) center of gravity position G2 is shifted by a distance (d), which makes accurate detection of a color shift amount impossible using this signal.

In the embodiment of the present invention, therefore, for the detection of color shift, only the signal D1 output from the photodiode 31 of the first light-receiving element 35 is used to calculate the resist pattern center of gravity position and detect the amount of color shift with accuracy. In this way, the amount of color shift can be accurately detected at all times.

Stabilization control using the output from the AIDC sensors in this embodiment will now be explained. In the image forming apparatus of this embodiment, when any of the image forming units is removed for the purposes of replacement or maintenance work, or when the number of copies has exceeded a prescribed number (500 for example), image darkness adjustment and resist adjustment are performed as stabilization control prior to an actual image formation operation.

Figure 11:
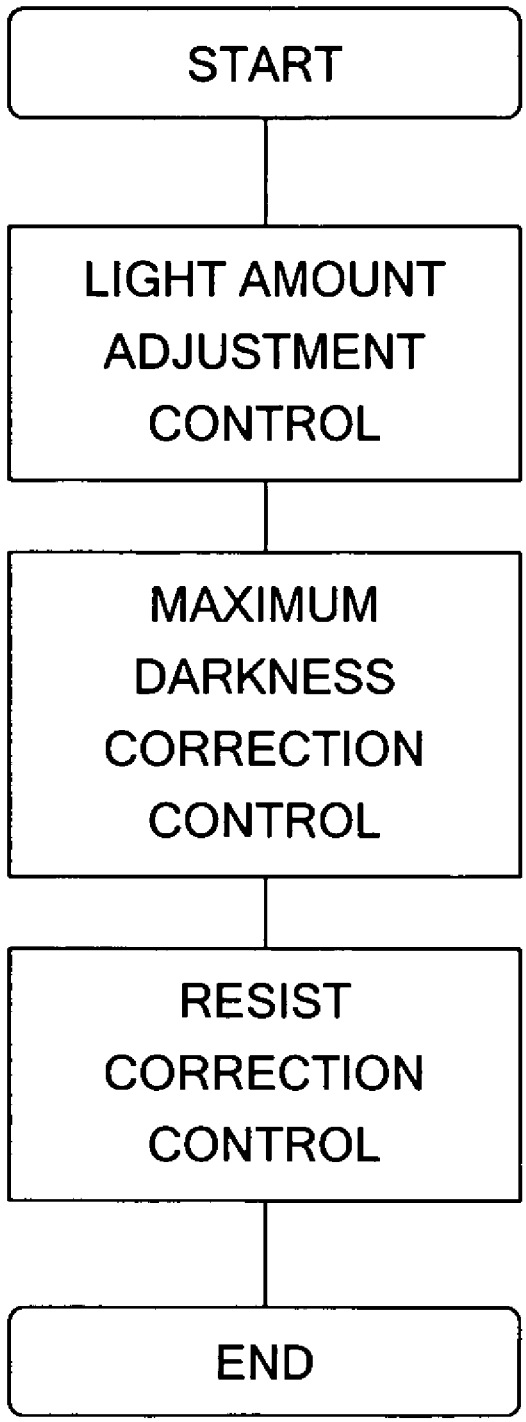
FIG. 11 is a flow chart to explain the stabilization process carried out by the processing circuit.

FIG. 10 is a drawing to explain the toner patterns formed on the intermediate transfer belt, and FIG. 11 is a flow chart to explain the stabilization process executed by the processing circuit 43. This embodiment includes two AIDC sensors 40 disposed at either edge of the intermediate transfer belt such that they face each other.

Yellow and cyan toner patterns are formed along one edge of the belt while black and magenta toner patterns are formed along the other edge of the belt. Specifically, rectangular toner patterns Q are formed first and then line patterns R are formed. The toner patterns Q consists of alternate cyan and yellow patterns (or black and magenta patterns). The patterns of the same color sequentially become lighter.

The toner patterns R consist of alternate cyan and yellow patterns (or black and magenta patterns), and the patterns of the same color retain the same darkness.

As the first part of the stabilization process, light amount adjustment for each AIDC sensor is performed. Specifically, a part of the intermediate transfer belt 11 on which no toner image is formed is irradiated by the light-emitting element 20 of each AIDC sensor 40, and the reflected light is received by the first light-receiving element 35 and the second light-receiving element 36. The darkness of the non-image area of the intermediate transfer belt 11 is measured based on the output signals from the first light-receiving element 35 and the second light-receiving element 36. The light amount from the light-emitting diode 21 of the light-emitting element 20 is then adjusted such that the darkness value becomes a prescribed value.

Maximum darkness correction control is then carried out. The rectangular toner patterns Q are irradiated via the light-emitting element 20 with the post-adjustment light amount. The reflected light is received by the first light-receiving element 35 and the second light-receiving element 36, and the darkness of each toner pattern is sought via calculation based on the output signals from these two light-receiving elements. The optimal development bias value is sought for each developing device from the measurement results of the toner patterns having different darknesses for each color.

Subsequently, resist correction control is performed. The line toner patterns Q are irradiated via the light-emitting element 20 with the post-adjustment light amount.

The reflected light is received by the first light-receiving element 35, and the position of each toner pattern is measured based only on the output signal from the first light-receiving element. In this embodiment, the distance from the black line patterns to the line patterns of each of the other colors is calculated, and the color shift amount regarding each color relative to black is sought by comparing the distance with a prescribed value.

In the embodiment described above, when the toner amount on the image carrier is calculated, halftone patterns, dot patterns, screen patterns or solid patterns can be used as toner patterns formed on the image carrier. However, toner patterns are not limited to these patterns only.

When calculating the color shift amount, calculation is carried out using line patterns. However, the calculation of the color shift amount is not limited to the use of line patterns, and any patterns that are useful in calculating of the color shift amount may be used.

In addition, the above embodiment was explained using an example in which the present invention was applied in a full-color image forming apparatus that includes an intermediate transfer belt, but needless to say, the present invention may be applied in any color image forming apparatus that uses toner of two or more colors.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A detection device, used in an image forming apparatus, comprising:

a light-emitting element which emits light towards a toner pattern formed on an image carrier;

a first light-receiving element which detects the light reflected from the toner pattern;

a second light-receiving element which detects the light reflected from the toner pattern in a fashion different from the first light-receiving element; and a control unit which calculates the amount of toner of the toner pattern based on the output values from the first and second light-receiving elements, and also calculates the position of the toner pattern based on the output value from the first light-receiving element, wherein said light-emitting element includes a polarizing plate, and said first light-receiving element includes a polarizing plate having a direction of polarization parallel to the polarizing plate of the light-emitting element, while the second light-receiving element includes a polarizing plate having a direction of polarization different from the polarizing plate of the light-emitting element.

2. A detection device as claimed in claim 1, wherein said control unit calculates the position of the toner pattern based on the detection value output by said first light-receiving element.

3. A detection device as claimed in claim 2, wherein said detection value output by the first light-receiving element is a wave form voltage represented by a wave having a width and height, the center of gravity position of the wave represents the position of the toner pattern.

4. A detection device as claimed in claim 1, wherein said control unit calculates the amount of toner of the toner pattern based on the difference between the detection value output by the first light-receiving element and the detection value output by the second light-receiving element.

5. A detection device as claimed in claim 1, wherein the amount of light emission from said light-emitting element is adjusted based on the toner amounts calculated based on the amount of reflected lights detected by the first and second light-receiving elements.

6. A detection device, used in an image forming apparatus, comprising:

a light-emitting element which emits light towards a toner pattern formed on an image carrier;

a first light-receiving element which detects the light reflected from the toner pattern;

a second light-receiving element which detects the light reflected from the toner pattern in a fashion different from the first light-receiving element; and a control unit which calculates the amount of toner of the toner pattern based on the output values from the first and second light-receiving elements, and also calculates the position of the toner pattern based on the output value from the first light-receiving element, wherein said calculation of said control unit is carried out using halftone patterns, dot patterns, screen patterns or solid patterns as the toner patterns when the toner amount of the toner pattern is calculated, and the calculation is performed using line patterns when the position of the toner pattern is calculated.

7. An image forming apparatus comprising:

an intermediate transfer unit;

a plurality of image forming units disposed to the intermediate transfer unit;

a plurality of transfer elements which sequentially transfer toner patterns formed by each of said image forming units onto the intermediate transfer unit;

a light-emitting element which emits light towards the toner patterns formed on the intermediate transfer unit;

a plurality of light-receiving elements each of which detects the reflected light from the toner patterns; and a control unit which calculates the toner amount of each toner pattern based on the output values from said plurality of light-receiving elements, and also calculates the position of each toner pattern based on the output value from one of the light-receiving elements, wherein said light-emitting element includes a polarizing plate, and one of light-receiving elements includes a polarizing plate having a direction of polarization parallel to the polarizing plate of the light-emitting element, while another of said light-receiving elements includes a polarizing plate having a direction of polarization different from the polarizing plate of the light-emitting element.

8. An image forming apparatus as claimed in claim 7, wherein said control unit calculates the position of the toner pattern based on the detection value output by said one of the light-receiving elements.

9. An image forming apparatus as claimed in claim 8, wherein said detection value is a wave form voltage represented by a wave having a certain width and height, the center of gravity position of the wave represents the position of the toner pattern.

10. An image forming apparatus as claimed in claim 7, wherein said control unit calculates the amount of toner of the toner pattern based on the difference between the detection values.

11. An image forming apparatus as claimed in claim 7, wherein the amount of light emission from said light-emitting element is adjusted based on the toner amounts calculated based on the amount of reflected lights detected by said plurality of light-receiving elements.

12. An image forming apparatus, comprising:

an intermediate transfer unit;

a plurality of image forming units disposed to the intermediate transfer unit;

a plurality of transfer elements which sequentially transfer toner patterns formed by each of said image forming units onto the intermediate transfer unit;

a light-emitting element which emits light towards the toner patterns formed on the intermediate transfer unit;

a plurality of light-receiving elements each of which detects the reflected light from the toner patterns; and a control unit which calculates the toner amount of each toner pattern based on the output values from said plurality of light-receiving elements, and also calculates the position of each toner pattern based on the output value from one of the light-receiving elements.

wherein said calculation of said control unit is carried out using halftone patterns, dot patterns, screen patterns or solid patterns as the toner patterns when the toner amount of the toner pattern is calculated, and the calculation is performed using line patterns when the position of the toner pattern is calculated.

13. A toner amount and color shift amount calculation method employed in a color image forming apparatus, said method comprising steps of:

irradiating a toner pattern formed on an image carrier with light from an irradiation element via a polarizing plate;

detecting the amount of light reflected form said toner pattern using a plurality of light-receiving elements; and calculating the toner amount of the toner pattern on the image carrier and the position of the toner pattern based on the amount of reflected light detected by the light-receiving elements, wherein when the toner amount on the image carrier is calculated, calculation is carried out based on the amount of reflected light detected by two or more light-receiving elements, and when the color shift amount is calculated, calculation is carried out based on the amount of reflected light detected by one light-receiving element.

* * * * *